United States Patent [19]

Hammond

[11] Patent Number: 4,990,746

[45] Date of Patent: Feb. 5, 1991

[54] ELECTRIC WATER HEATER UTILIZING TRAPPED AIR TO PROVIDE EXPANSION SPACE

[75] Inventor: Brian W. Hammond, Coltishall, United Kingdom

[73] Assignee: Heatrae Sadia Heating Limited, Hurrican Way, United Kingdom

[21] Appl. No.: 309,283

[22] Filed: Feb. 10, 1989

[30] Foreign Application Priority Data

Feb. 11, 1988 [GB] United Kingdom ..... 8803181
Aug. 4, 1988 [GB] United Kingdom ..... 8818552

[51] Int. Cl.[5] ..... H05B 1/00; F24H 1/18; B67D 5/62

[52] U.S. Cl. ..... 392/441; 222/108; 222/146.5; 392/449

[58] Field of Search ..... 219/306, 310, 312, 314; 222/146.5, 146.1, 108, 66

[56] References Cited

U.S. PATENT DOCUMENTS 3,581,057 5/1971 Meyers ..... 219/306 X
4,441,902 4/1984 Jardine ..... 62/238.6
4,513,887 4/1985 Wicke et al. ..... 222/146.5

FOREIGN PATENT DOCUMENTS 3012590 1/1982 Fed. Rep. of Germany .
3642583 6/1987 Fed. Rep. of Germany .
3631178 10/1987 Fed. Rep. of Germany .
2444896 7/1980 France .
527274 10/1940 United Kingdom .

*Primary Examiner*—Anthony Bartis
*Attorney, Agent, or Firm*—Vaden, Eickenroht, Thompson & Boulware

[57] ABSTRACT

There is provided a heater which includes a vessel in which liquid is contained, and a heater to heat the liquid, the vessel having an inlet by which liquid can be fed into the vessel, and an outlet through which liquid may flow to a point of delivery. The inlet comprises a supply conduit connected to a liquid supply, and liquid flowing along the supply conduit is mixed with a gas. A gas trap is provided to collect gas passing with the liquid from the supply conduit within the vessel, and includes an opening to release collected gas into the vessel, whereby at least when the liquid flow along the supply conduit is stemmed, the released gas provides an expansion space in the vessel into which liquid can expand during subsequent heating, the expansion space being vented from the vessel. An air control valve restricts the amount of gas available for mixing with the liquid as the liquid flow rate through the supply conduit increases, thereby preventing aeration of the liquid.

20 Claims, 5 Drawing Sheets

ELECTRIC WATER HEATER UTILIZING TRAPPED AIR TO PROVIDE EXPANSION SPACE

BACKGROUND TO THE INVENTION

This invention relates to a heater of the kind, hereinafter referred to as "the kind specified" including a vessel in which liquid is contained, means being provided to heat the liquid in the vessel. More particularly, but not exclusively, the invention has been devised for use as a water heater.

DESCRIPTION OF THE PRIOR ART

Water heaters are known which are situated at or adjacent a point of use e.g., beneath or above the sink. Relatively cold water is let into the reservoir from a supply by a valve, and this forces already heated water from the reservoir, usually upwardly, into a delivery conduit which has an open end positioned to deliver water into for example, a sink.

The open end of the conduit is permanently open i.e., the heater is vented and as water in the reservoir is heated and expands, the pressure which would otherwise be generated within the reservoir is relieved through the delivery conduit.

Usually, the conduit is of small volume compared with the reservoir and so water tends to rise into the conduit and hence can drip from the open end of the supply conduit into the sink, as the water is heated and expands.

Whilst the volume of hot water wasted in this way is small, the advantage of a vented heater is that it is inherently safe because there is no valve in the delivery conduit which could be closed such that the pressure could build up dangerously in the reservoir.

However it is desirable not to have water dripping from the open end of the conduit into the sink.

SUMMARY OF THE INVENTION

According to one aspect of the invention we provide a heater of the kind specified having a heating vessel with an inlet means by which liquid can be fed into the vessel, and an outlet through which liquid may flow to a point of delivery, the inlet means a supply conduit connected to a liquid supply, and means are provided to mix gas with liquid flowing along the supply conduit. A gas trap collects gas passing with the liquid from the supply conduit within the vessel, and includes means to release gas collected thereby into the vessel at least when the liquid flow along the supply conduit is stemmed, the released gas providing an expansion space in the vessel into which liquid can expand during supsequent heating, and the expansion space being vented from the vessel.

Thus the problem of dripping at the point of delivery is overcome whilst the benefit of the safety of a vented heater are retained.

Preferably the expansion space is vented through the outlet of the heater which may be connected to a delivery conduit which extends to the point of delivery. Thus the outlet is preferably positioned at an upper end of the vessel at which the released gases collect.

The means to introduce gas into the following liquid and the amount of gas collected by the gas trap is preferably arranged such that the amount of gas trapped can displace enough liquid to allow the liquid to expand in the vessel without itself being vented. It will be appreciated that in practice, the liquid in the vessel displaces the gas in the gas trap thus causing the liquid level in the vesel to fall to provide the expansion space above the liquid level.

The gas trap conveniently comprises a container having an opening in a bottom surface thereof through which the liquid can pass from the supply conduit into the vessel.

Although some gas may pass with the liquid into the vessel and hence pass to the outlet of the vessel, sufficient gas can be collected which, when released can provide a sufficiently large expansion space for the expanding liquid. The container may have a small opening in an upper part thereof through which the collected gas may be released into the vessel or preferably the supply conduit may have a small opening therein at a positon preferably adjacent its point of connection to the container, whereby the gases collected in the container may escape from the container at least when the liquid flow along the supply conduit is stemmed. Of course in each case, when liquid is flowing through the supply conduit some gas may escape from the container via the small opening, but the rate of release will be small.

The supply conduit may communicate with the upper part of the gas trap. Where the small opening is provided in the container, the supply conduit may be isolated from the small opening to enhance gas collection and to prevent gas escaping from the gas trap back in to the supply conduit when the flow of liquid along the conduit is stemmed. This may be achieved by providing a tube of cylindrical or other form which depends from the upper surface of the container around the conduit. It has been found that a tube which extends downwardly for about two-thirds of the height of the container, provides for the most efficient collection of gas. Of course, such a tube is not required where the small opening is provided in the supply conduit.

The means to mix gas with the liquid during liquid flow may comprise a jet pump having an inner swirl chamber through which the liquid passes and into which the gas is drawn. The swirl chamber may have a transverse gas inlet, and the liquid may be fed through a central region of the chamber and into the chamber in a longitudinal direction. Means may be provided to turbulate the flowing liquid just prior to mixing with the gas, such turbulation being caused by a member provided to constrict but not obstruct the liquid flow.

Means may be provided to control the flow of gas to the means which mix the gas with the liquid, such as for example, a valve which limits the quantity of gas drawn in by the jet pump, where provided, for mixing with the liquid.

The heater is preferably a water heater with an immersed heating element which may be positioned at a lower end of the vessel or as required. The supply conduit may enter the vessel through an upper surface thereof, or through a side thereof as required, but preferably the conduit extends downwardly into the container of the gas trap.

The electrical element mayi be thermostatically controlled to heat the water in the vessel to below boiling point e.g., up to 90° C. only, from ambient temperature. It will be appreciated that the liquid in the vessel when heated through this range will expand by around 4% in volume and hence it is desirable for the gas trap to collect sufficient gas to provide an expansion space of about % of the volume of the water in the vessel. Thus the container of the gas trap may have a volume of at least 4% of the volume of the vessel.

BRIEF DESCRIPTION OF THE DRAWINGS

The inventon will now be described with reference to the accompanying drawings in which.

DESCRIPTION OF THE PREFERRED EMBODIMENTS

Figure 1:
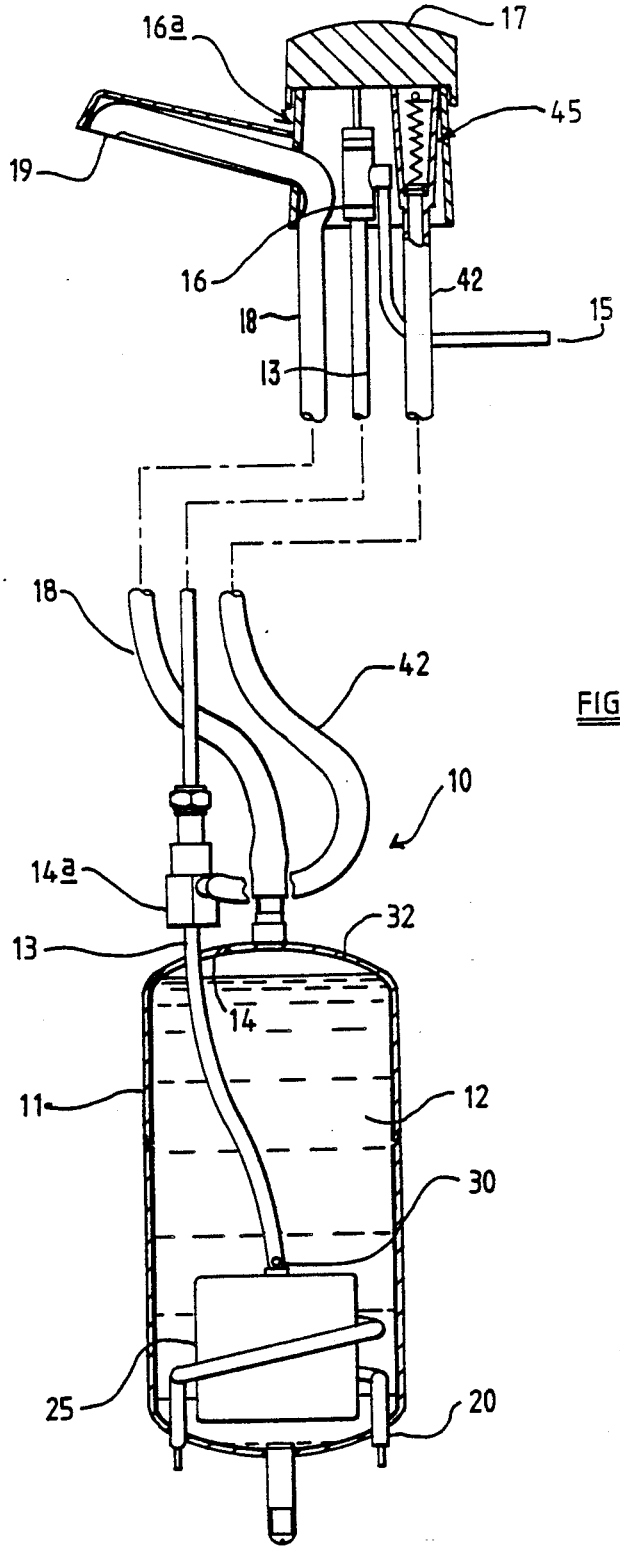
FIG. 1 is an illustrative side view through a water heater in accordance with the invention.

Referring to the drawings, a water heater 10 comprises a vessel 11 in which water 12 is contained. The vessel 11 in the example shown is generally cylindrical in cross-section, and a supply conduit 13 extends downwardly through an upper surface 14 of the vessel to feed relatively cold water into the vessel 11.

Just prior to entering the vessel 11, the water passes through a jet pump **14*a*** where air is mixed with the water as it flows along the conduit.

The conduit 13 is connected to a water supply 15 and a valve 16 which is housed in a tap body **16*a* is provided in the conduit 13 to control the water flow along the conduit 13**.

As shown, the tap body **16*a* comprises a manually engagable member 17 which may be rotated to open and close valve 16 to control the flow of water along the conduit 13. A delivery conduit 18 which also communicates with the upper surface 14 of the vessel 11 passes through the tap body 16*a* to a delivery point 19** which in use, would be positioned over a sink or the like where it is desired to use the hot water.

Within the vessel 11 an electriccally operated heating element 20 is provided which is thermostatically controlled to heat the water in the vessel 11.

The lower end of the conduit 13 communicates with a gas trap 25 (see FIG. 3) which comprises a container having a generally open lower end 26.

It will be appreciated that by virtue of the jet pump **14*a*, air which is mixed with the water flowing through conduit 13, will pass with the liquid into the gas trap 25 and a proportion of the gas carried in the liquid will be trapped by the gas trap 25. The supply conduit 13, adjacent to the container 25, is provided with a small opening 30. A proportion of the gas thus trapped will pass from the container 25 through the small opening 30 during liquid flow and will bubble upwardly through the liquid in the vessel 11 and pass with the liquid from the vessel along the delivery conduit 18. However, when the valve 16 in the conduit 13 is closed so that water no longer flows along the conduit 13, any further gas released through the small opening 30 will be replaced by water from the vessel 11 and this will have the effect of lowering the water level in the vessel to provide an expansion space as indicated at 32 in FIG. 1**.

When the container 25 is full of gas and liquid flow down conduit 13 continues, an equilibrium will be established with excess air passing from the container with the liquid, and being vented from the vessel with liquid, through delivery conduit 18.

Figure 4:
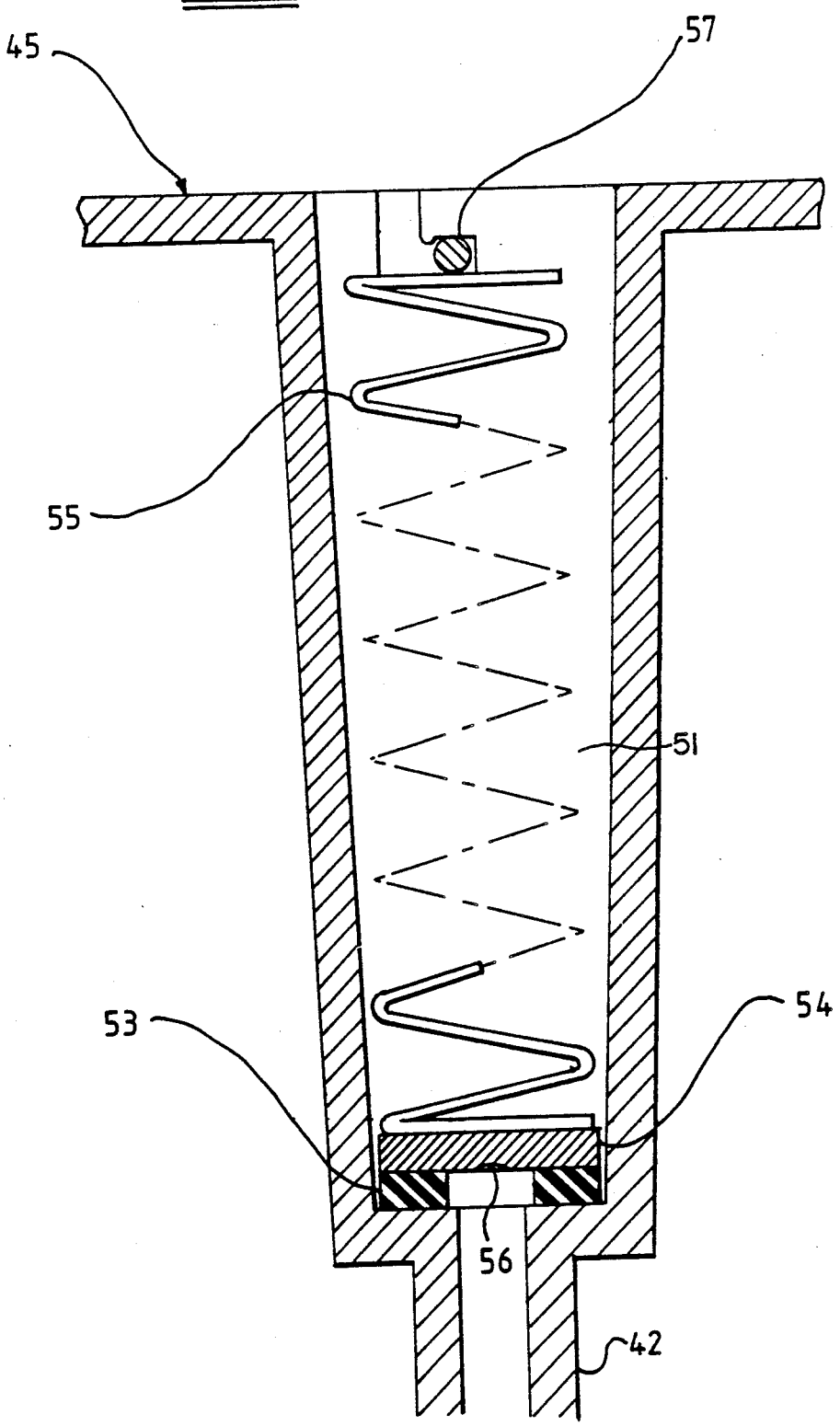
FIG. 4 is an enlarged view of a yet further part of the heater of FIG. 1.

The amount of air permitted to mix with the liquid in the jet pump **14*a* is controlled by a valve 45 as illustrated in FIG. 4**, and described below.

In the example described, the electrical element 20 is thermostatically controlled to heat the water in the vessel 11 to below boiling point e.g. up to 90° C. only, from ambient temperature. It will be appreciated that the liquid in the vessel 11 when heated through this range will expand by around 4% in volume and hence it is desirable for the gas trap 25 to collect sufficient gas to provide an expansion space 32 of about 4% of the volume of the water in the vessel. Thus the container of the gastrap 25 has a volume of at least 4% of the volume of the vessel 11. Thus the water 12 can expand into the expansion space 32 which is vented by virtue of the delivery conduit 18 being open to the delivery point 19.

Thus the heater is inherently safe as there can be no build up of pressure within the vessel 11 because the heater is permanently vented, and futhermore, the problems associated with known heaters of this kind, i.e., water dripping at the delivery point 19, is overcome because the water can expand into the expansion space 32 during heating rather than having to pass along conduit 18 and from the delivery point 19.

Various modifications are possible without departing from the scope of the invention.

In the example described, the tap body **16*a* includes a delivery spout for delivering how water into a sink, and a valve means for controlling the flow of water along the conduit 13**. In another arrangement, a separate spout and valve means may be provided.

Figure 3:
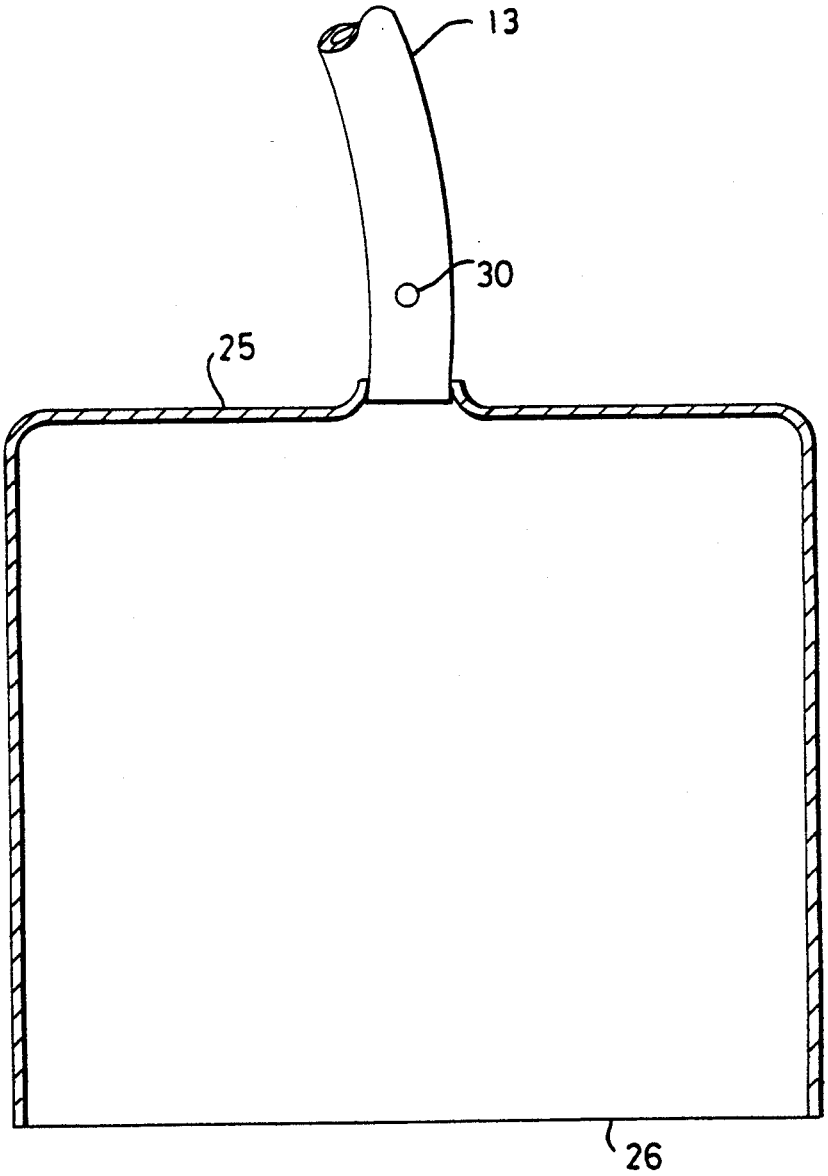
FIG. 3 is an enlarged view of a further part of the water heater of FIG. 1.
Figure 5:
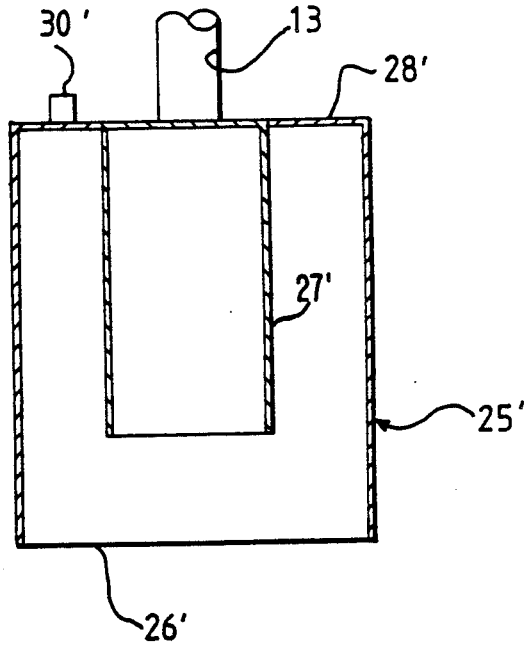
FIG. 5 is a view similar to FIG. 3 but showing an alternative arrangement.

Instead of the container 25 being as shown in FIG. 3, alternative arrangements are possible, for example as shown at 25' in FIG. 5. In this alternative arrangement, there is a cylindrical tube 27' in the container 25' which surrounds the open end of the conduit 13. In an upper surface 28' of the container, a small opening 30' is provided to permit air trapped in the space between the tube 27' and the inner wall of the container 25' to pass from the container 25' into the vessel 11 and provide the expansion space 32.

It is desired, the tube 27' within the container 25' need not be cylindrical as described, but could be of any configuration although it has been found that making the tube 27' about two-thirds as long as the container is deep, results in optimum gas collection.

The conduit 13 may enter the vessel 11 through a side wall instead of through the top, or even through the bottom thereof, although the conduit must extend downwardly into the gas trap 25 so that gas passing from the conduit can be trapped.

In another arrangement, if desired the expansion space 32 could be vented by means separate to the delivery conduit 18, although the arrangement described is preferred.

The arrangement may be applied not only to a water heater as described, but to any other desired type of heater of the kind specified. Futhermore, the heating means need not comprise an electrical heating element as shown at 20, but any other heating element as required, which need not be immersed in the liquid.

Figure 2:
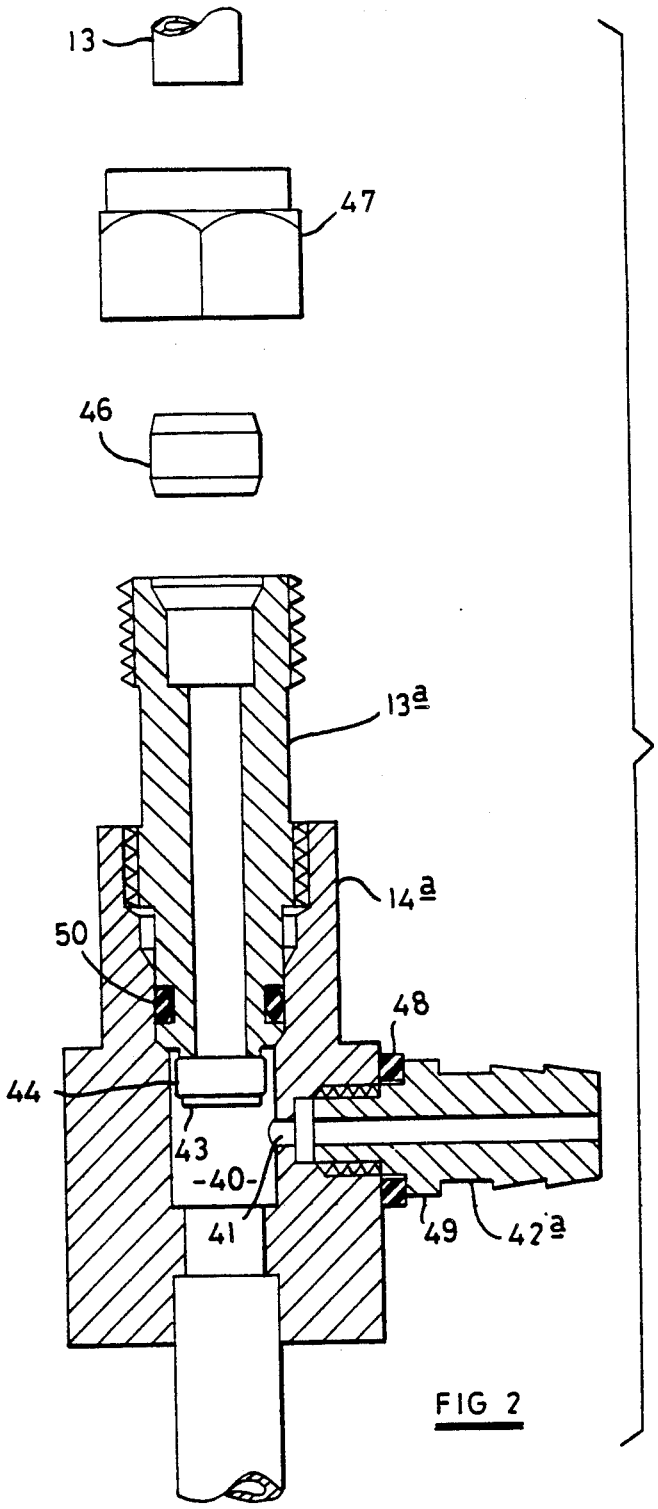
FIG. 2 is an enlarged partially exploded view of part of the water heater of FIG. 1.

Referring now to FIG. 2, the construction of the jet pump **14*a* is shown in more detail. This comprises a swirl chamber 40 having a transverse inlet 41 through which air can be drawn from atmosphere via an air pipe 42 which is connected to the pump 14*a* via an adaptor 42*a*, and extends upwardly to valve 45 located in tap housing 16*a* as seen in FIG. 1**.

The water flows longitudinally through the swirl chamber 40 from an adaptor 13*a* connected to conduit 13, and just prior to entering the swirl champer 40 as shown at 43, a transverse pin 44 passes through the adaptor 13*a* and has the effect of turbulating the water which facilitates mixing the water with the air being drawn into the swirl chamber 40 through the inlet 41.

Other types of jet pump could be used.

The supply conduit 13 is connected to the pump 14*a* via a compression joint including a compressing ring 46 and lock nut 47, although other types of connection could be provided as required.

As can be seen from FIG. 2, a washer 48 is provided between a flange 49 of adaptor 42*a* to form a seal, and a sealing ring 50 is provided to form a seal between adaptor 13*a* and the pump 14. Other arrangements are possible.

Referring to FIG. 4, the valve 45 has a chamber 51 open to atmosphere, and a valve seat formed byi an annular rubber washer 53. An air bleed washer 54 is urged towards the washer 53 by a spring 55 but air is permitted to enter the air feed pipe 42 by virtue of the air bleed washer 54 having a finely toleranced groove 56 in its underside.

The spring 55 is retained by a pin 57 which extends across the chamber 51.

As water flows through the jet pump 14*a*, a vacuum is created in the air feed line 42 and air is thus drawn into the chamber 51, through valve 45 past the washers 53, 54, into the air feed line 42. As water flow increases, the vacuum created increases, and the washer 54 is sucked down harder into engagement with the seal provided by the washer 53. The groove 56 is thus restricted so as to restrict air flow and ensure that too much air is not drawn into the jet pump 14 and mixed with the water which can cause excessive aeration of the water.

Other types of air control valve, where required, may be provided.

Instead of air being mixed with the water, particularly where the heater 10 is heating a liquid other than water, it may be desirous to use a gas other than air to mix with the liquid.

The features disclosed in the foregoing description, or the following claims, or the acccompanying drawings, expressed in their specific forms or in terms of a means for performing the disclosed function, or a method or process for attaining the disclosed result, or a class or group of substances or compositions, as appropriate, may, separately or in any combination of such features, be utilised for resealing the invention in diverse forms thereof.

I claim:

1. A heater having a vessel with an inlet means by which liquid can be fed into the vessel, a permanently open outlet through which liquid may flow to a point of delivery, the inlet means comprising a supply conduit connected to a liquid supply, mixing means associated with the supply conduit to mix gas with the liquid flowing along the supply conduit, control means to control the flow of gas to the mixing means and thus to restrict the amount of gas available for mixing with the liquid as liquid flow along the supply conduit increases, a gas trap provided within the vessel at an open end of the supply conduit to collect gas passing with the liquid from the supply conduit, the gas trap including means to release the gas collected therebyi into the vessel, at least when the liquid flow along the supply conduit is stemmed, the release of gas providing an expansion space in the vessen into which liquid in the vessel can expand during subsequent heating, the expansion space being vented from the vessel.

2. A heater according to claim 1 wherein the expansion space is vented through the outlet of the heater.

3. A heater according to claim 2 wherein the outlet is connected to a delivery conduit which extends to the point of delivery.

4. A heater according to claim 1 wherein the outlet is positioned at an upper end of the vessel at which the released gasses collect.

5. A heater according to claim 1 whereini the means to introduce gas into the flowing liquid and the amount of gas collected by the gas trap are arranged such that the amount of gas trapped can displace enough liquid to allow the liquid to expand in the vessel without itsel being vented.

6. A heater according to claim 1 wherein the gas trap comprises a contianer having an opening in a bottom surface thereof through which the liquid can pass from the supply conduit into the vessel.

7. A heater according to claim 6 wherein the container has a small opening in an upper part thereof through which the collected gas is released into the vessel.

8. A heater according to claim 7 wherein the supply conduit is isolated from the small opening to enhance gas collection and to prevent gas escaping from the gas trap back in to the supply conduit when the flow of liquid along the conduit is stemmed.

9. A heater according to claim 8 wherein a tube of cylindrical form is provided which depends from the upper surface of the container around the conduit.

10. A heater according to claim 9 wherein the tube extends downwardly for about two thirds of the height of the container.

11. A heater according to claim 6 wherein the supply conduit has a small opening therein at a position such that the gas collected by the container mayi escape from the container at least when the liquid flow along the supply conduit is stemmed.

12. A heater according to claim 11 wherein the opening in the supply conduit is located adjacent the point of connection of the supply conduit with the container.

13. A heater according to claim 6 wherein the supply conduit enters the vessel and extends downwardly into the contianer of the gas trap.

14. A heater according to claim 6 wherein the container of the gas trap is dimensioned to collect sufficient gas to provide an expansion space of about 4% of the volume of the water in the vessel.

15. A heater according to claim 1 wherein the supply conduit communicates with the upper part of the gas trap.

16. A heater according to claim 1 wherein the means to mix gas with the liquid during liquid flow comprises a jet pump having an inner swirl chamber through which the liquid passes and into which the gas is drawn.

17. A heater according to claim 16 wherein the swirl chamber has a transverse gas inlet, and the liquid is fed through a central region of the chamber and into the chamber in a longitudinal direction.

18. A heater according to claim 16 wherein means are provided to turbulate the flowing liquid just prior to mixing with the gas, such turbulation being caused by a member provided to constrict but not obstruct the liquid flow.

19. A heater according to claim 1 which is a water heater with an immersed heating element.

20. A heater according to claim 19 when the element is positioned at a lower end of the vessel.

* * * * *